US005112253A

United States Patent [19]

Swift

[11] Patent Number: 5,112,253

[45] Date of Patent: May 12, 1992

[54] ARRANGEMENT FOR REMOVABLY MOUNTING A TRANSIENT SUPPRESSION OR ELECTRICAL FILTER DEVICE IN AN ELECTRICAL CONNECTOR

[75] Inventor: Peter R. Swift, Toronto, Canada

[73] Assignee: Amphenol Corporation, Wallingford, Conn.

[21] Appl. No.: 745,185

[22] Filed: Aug. 15, 1991

[51] Int. Cl.[5] ..... H01R 13/66

[52] U.S. Cl. ..... 439/620; 333/185; 439/608

[58] Field of Search ..... 439/608, 620; 333/181-185

[56] References Cited

U.S. PATENT DOCUMENTS

| | | | |
|---|---|---|---|
| 3,200,355 | 8/1965 | Dahlen | 333/79 |
| 3,854,107 | 12/1974 | Tuchto et al. | 439/586 |
| 3,951,514 | 4/1976 | Medina, Jr. | 350/96 |
| 4,572,600 | 2/1986 | Nieman | 439/92 |
| 4,582,385 | 4/1986 | Couper et al. | 439/620 |
| 4,600,262 | 7/1986 | Nieman et al. | 439/608 |
| 4,707,048 | 11/1987 | Gliha et al. | 439/620 |
| 4,741,710 | 5/1988 | Hogan et al. | 439/620 |
| 4,746,310 | 5/1988 | Morse et al. | 439/620 |
| 4,747,789 | 5/1988 | Gliha | 439/620 |
| 4,772,221 | 9/1988 | Kozlof | 439/549 |
| 4,846,732 | 7/1989 | Meelhuysen | 439/620 |

*Primary Examiner*—Gary F. Paumen
*Attorney, Agent, or Firm*—Bacon & Thomas

[57] ABSTRACT

An arrangement for removably mounting filter or transient suppression components in a connector includes an insulator having a plurality of feedthrough contact openings and a plurality of openings for the components. The components are electrically connected to the contacts via fixed conductive clips in the component openings, the clips including integral spring members for engaging the feedthrough contacts. The components are also connected to a ground plate by spring members extending into the component openings for biasing each component against a respective clip, thereby permitting separate removal of each component and contact pin.

15 Claims, 4 Drawing Sheets

ARRANGEMENT FOR REMOVABLY MOUNTING A TRANSIENT SUPPRESSION OR ELECTRICAL FILTER DEVICE IN AN ELECTRICAL CONNECTOR

BACKGROUND OF THE INVENTION

1. Field of the Invention

This invention relates to electrical connectors, and in particular to an arrangement for removably mounting a transient suppression or electrical filter device in an electrical connector.

2. Description of Related Art

It has previously been proposed to place diodes and other nuclear electromagnetic pulse (EMP) or transient voltage suppression (TVS) electrical components on electrical contacts for the purpose of facilitating their use in high or medium density electrical connectors. Examples are shown in U.S. Pat. Nos. 4,741,710,4746,310, and 4,747,789. Present technology, exemplified by the connectors shown in these patents, requires that the component be mounted on the contact by the connector manufacturer.

The step of bonding the component to the contact greatly increases the cost of manufacturing a connector because connector assemblers or manufacturers ordinarily do not possess the state-of-the-art technology required to permanently bond a semiconductor diode or other component chip directly to a contact. Therefore, the connector assembler is required to either purchase or develop the requisite technology, or to manufacture the contact and send it back to the diode manufacturer for attachment of the semiconductor chip to the contact.

Generally, it is the connector assembler who bonds the component to the contact. The assembler is thus required to handle the component, modify the standard contact, complete the attachment of the component to the contact, and perform screen testing on the contact assembly which is over and above the screening performed by the component manufacturer. Such redundant testing is inefficient, as is the need to handle the component by both the manufacturer and the connector assembler, and the extra steps required to prepare or machine the contact to accommodate the component. All of these disadvantages could be avoided if a satisfactory arrangement existed for non-permanently but securely mounting a component together with a contact in a connector. However, no such arrangement exists.

Further, although permanent attachment of the component to the contact is convenient in that it permits the contact and component to be removed together from the connector for repair or replacement, at least prior to potting, the consequent inability to separately remove the contact and the component from the connector is disadvantageous because wastage may result if only the contact or the component requires repair. Again, this problem would be solved if there existed a satisfactory arrangement for non-permanently mounting a component together with its contact in a connector.

It has previously been proposed to place a diode chip loosely within a connector capacitor filter array in order to facilitate testing and removal, as described in U.S. Pat. No. 4,707,048. However, the device disclosed in the patent lacks mechanical stability and exposes the diode to damage if replacement is attempted. Nevertheless, the principle of non-permanent mounting of a component on a contact clearly has merit. What is needed is an arrangement for safely placing a diode chip or other component within an electrical connector such that the component is separately removable from the contact, and in which electrical connections between the component, the contact, and ground are as mechanically stable as if the component were bonded to the contact. The present invention provides such an arrangement.

While diodes are the most frequently used transient suppression components in the above-described type of connector, it has also been proposed to use metal oxide varistors or spark gap devices for transient suppression purposes and, in a similar context, to use capacitor chips for filtering purposes in medium or high density connectors. The disadvantages of the prior art mounting arrangements for diodes also apply to these alternative types of transient suppression and filter components.

SUMMARY OF THE INVENTION

In order to solve the above-mentioned disadvantages of prior arrangements for removably mounting transient suppression or filter components within connectors, it is an objective of the invention to provide a mechanically stable arrangement for safely yet removably mounting a transient suppression or filter component within a connector, in which the component is separately removable from the contact.

It is a further objective of the invention to provide a connector arranged to permit removable mounting of both a contact and its associated filter and/or transient suppression component.

It is a still further objective of the invention to provide arrangement for removably mounting a transient suppression or filter component in a connector having standard feedthrough contacts.

These objectives are achieved by providing a component mounting arrangement which includes a component holder slotted to receive the component, a metal contact clip which provides a releasable mechanical and electrical interface between the component and the contact, and a ground plate utilizing integral spring tines for electrically connecting the component to ground and for releasably securing the component in the holder.

In a preferred embodiment of the invention, the plastic insulator/holder is designed with multiple cavities to accept a plurality of metal contacts and, for each contact, a ground plate tine, a contact clip, and a filter or transient suppression component.

DETAILED DESCRIPTION OF THE PREFERRED EMBODIMENTS

In accordance with a first preferred embodiment of the invention, a connector having a conductive shell 1 includes a plurality of standard feedthrough contacts 2. The shell and feedthrough contacts are conventional and may be arranged in variety of configurations known to those skilled in the art. Contacts 2 may be in the form of pins, socket connectors, or other arrangements suitable for mating with corresponding contacts in a second connector or electrical device, or directly to conductors of a cable. It is of course intended that the invention encompass all such connector shell and pin configurations.

Feedthrough contacts 2, hereinafter referred to as pins or contact pins, may be removably retained in the connector by a latching tine or other suitable retention means (not shown), numerous different configurations being known to those skilled in the art. For example, the removable contact arrangement shown in U.S. Pat. No. 4,707,048 may be used with the novel component retention structure of the preferred embodiment.

Figure 3:
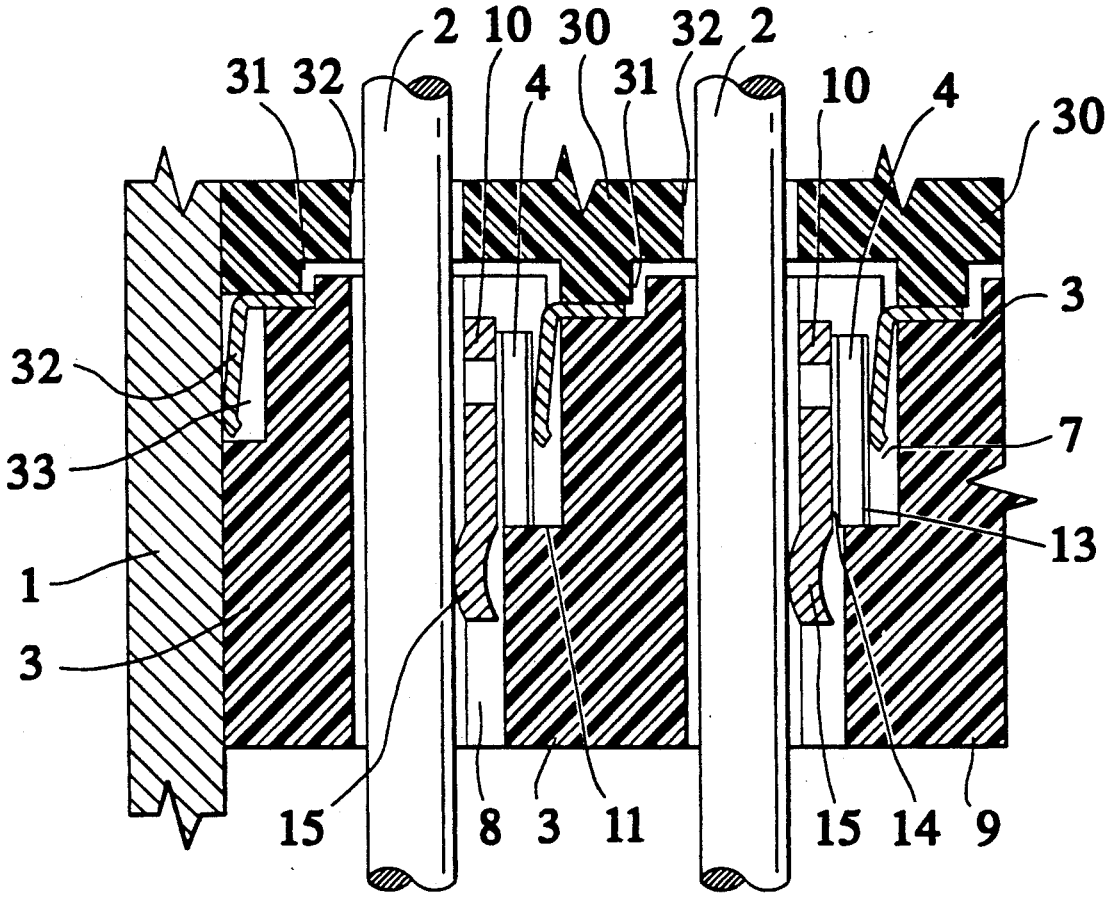
FIG. 3 is a cross sectional side view of the component mounting arrangement of FIG. 2.
Figure 4:
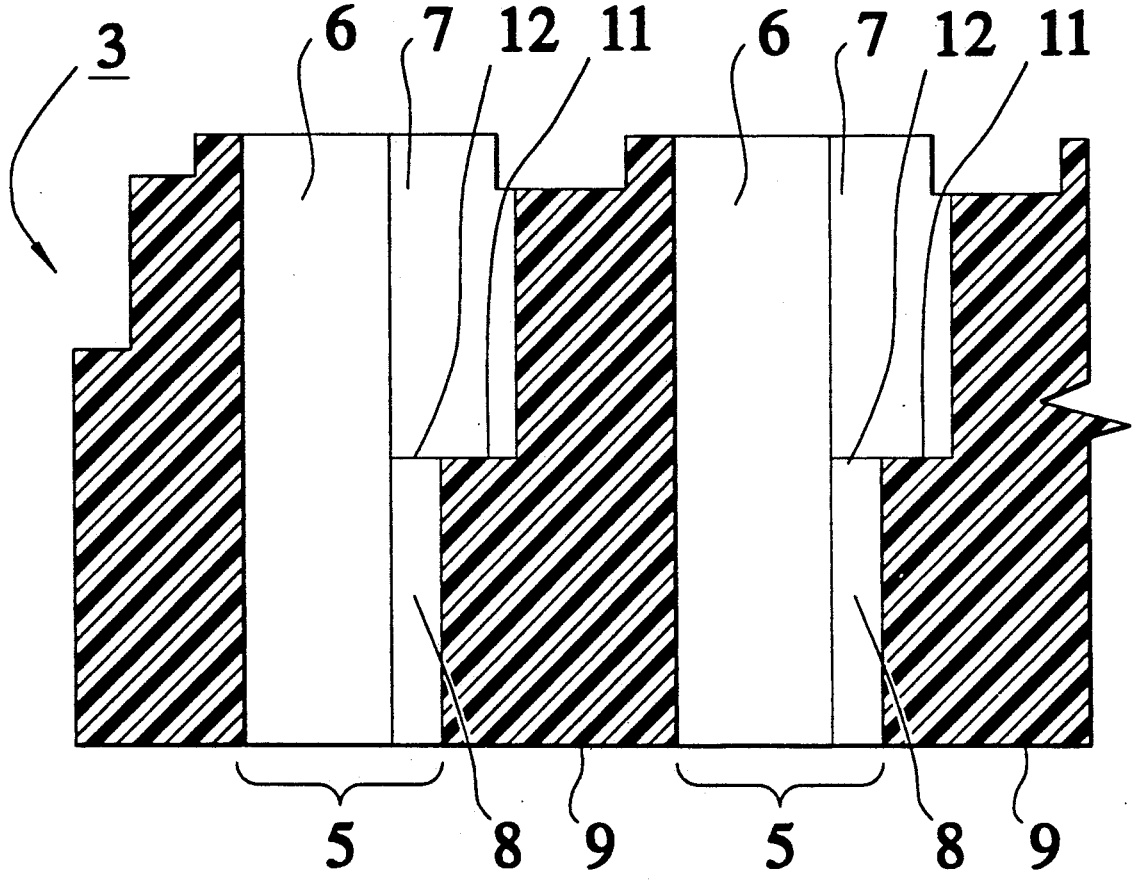
FIG. 4 is a cross sectional side view of the dielectric component holder of FIG. 2.

Dielectric insert 3, a portion of which is shown in each of FIGS. 1–4, and which is best shown in FIG. 3, is designed to removably support electronic components 4 within openings, apertures, or cavities 5. The shape of each opening 5 may be varied as required depending on the shape of the component in question. Openings 5 each includes a pin opening 6 and a component opening 7 in communication with pin opening 6.

Pin opening 6 completely through insulator 3 to permit passage of pin 2, while opening 7 extends sufficiently into the dielectric to accommodate component 4 and a contact clip 10. Component 4 and clip 10 are seated on floor 11 of opening 7. A passageway 8 communicates with opening 7 and opening 6, but has a width less than that of opening 7 such that portions 12 of floor 11 extend around the sides of passageway 8 to support contact clip 10.

A variety of electrical components have previously been employed in filter or transient suppression connectors, and it is anticipated that the invention will be applicable to all such components. For example, component 4 may be a Zener or transient suppression diode, a metal oxide varistor, a spark gap device, or a capacitor chip. For the embodiment shown, the component should have two electrodes 13 and 14 on opposed principal planar surfaces, although those skilled in the art will appreciate that other electrode configurations may be used with the invention by making minor modifications as necessary.

Figure 1:
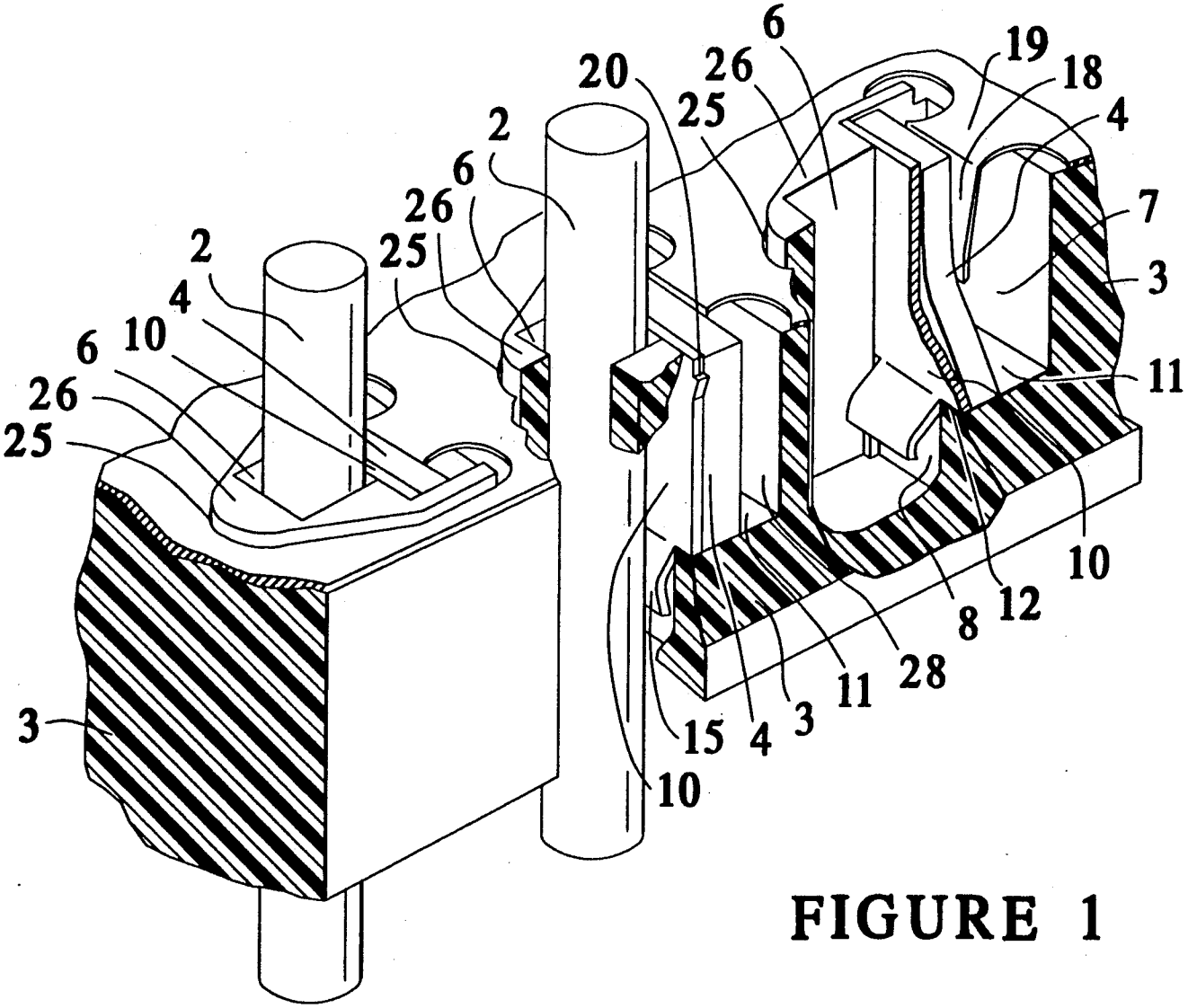
FIG. 1 is a partially cut away perspective view of a component mounting arrangement according to a preferred embodiment of the invention.
Figure 2:
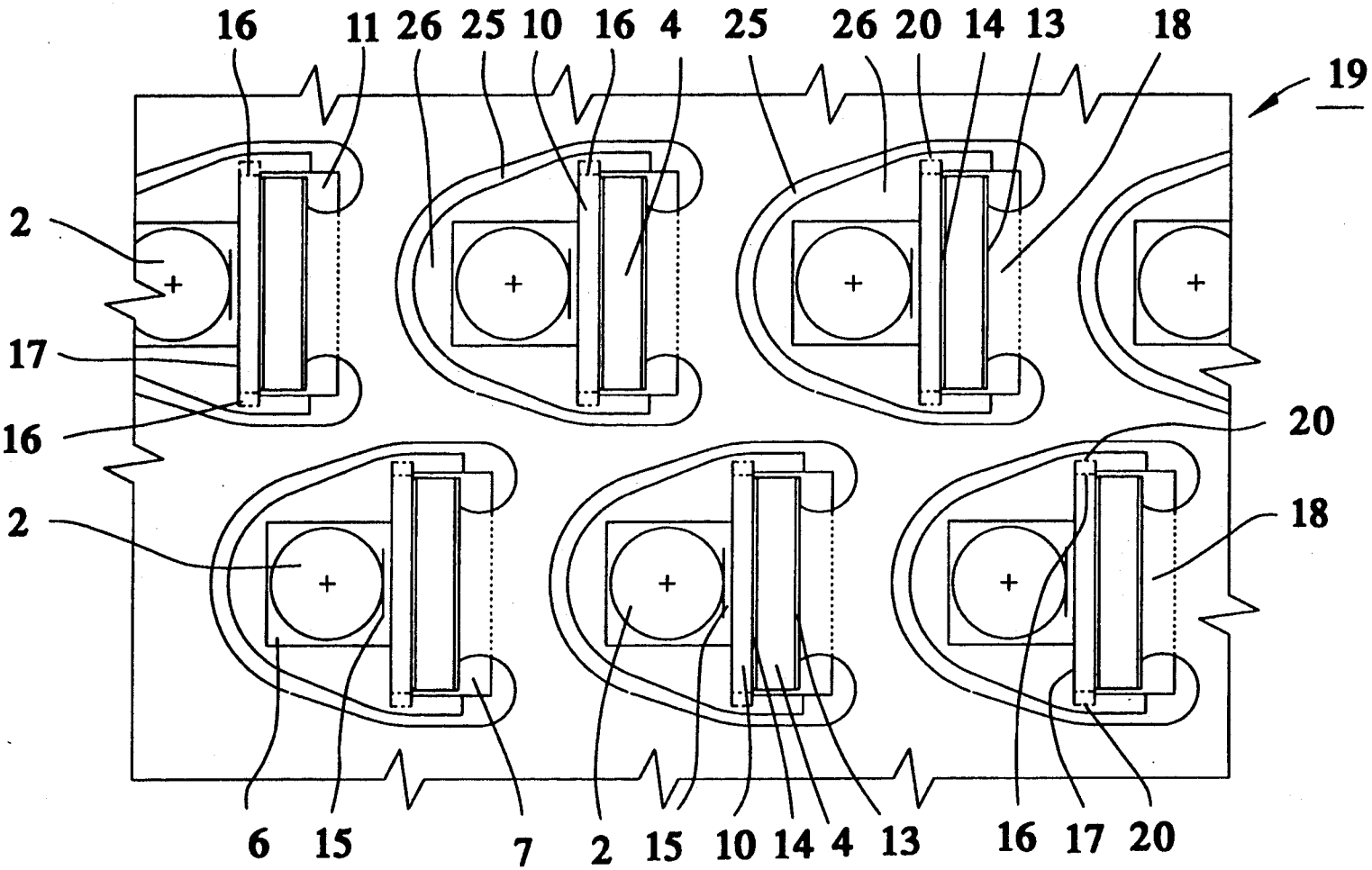
FIG. 2 is a top plan view of the arrangement of FIG. 1.

Component 4 is electrically connected to a corresponding contact pin 2 by a contact clip 10 formed from a resilient conductive material such as beryllium copper alloy or the like, with an integrally formed spring member 15, as follows: Clip 10 is supported on two sides by the floor portion 12 of opening 7 and by sidewalls 16 and wall 17. Passageway 8 receives member 15 as is best shown in FIGS. 1 and 3. Component 4 is supported by floor 11 and by sidewalls 16 such that electrode 14 directly contacts clip 10 when biased against clip 10 by spring member 18 of ground plate 19. Finally spring member 15 contacts pin 2 to complete the connection between electrode 14 and pin 2.

Contact clip 10 is preferably permanently secured to insulator 3. In an especially advantageous embodiment of the invention, contact clip 10 is secured to plastic insulator 3 by barbs 20 which penetrate sidewalls 16 and 17 to secure the clip and permit removal of the component and/or contact pins 2 without removal of the clip.

In FIG. 1, one of the openings 6 is shown with pin 2 removed for illustrative purposes. It will be appreciated that spring member 15 extends from passageway 8 into opening 6 when the pin is removed, and is pressed into passageway 8 when the contact is inserted to thereby provide a biasing force in the direction of pin 2 and ensure a good electrical connection between clip 10 and contact pin 2.

Connection of ground electrode 13 of component 4 to ground is effected via common ground plate 19 formed with a plurality of openings 25 shaped to correspond to the shape of raised sections 26 of insulator 3, which serve to insulate the contact pins from the ground plate. Ground plate 19 is preferably formed of a single stamped and formed plate. Ground contact spring members 18 are advantageously formed integrally with plate 19.

When the connector is assembled for testing, plate 19 is fitted over insulator 3 such that raised sections 26 of insulator 3 extend through openings 25 in plate 19 and spring members 18 extend into openings 7 of the insulator. Subsequently, component 4 is inserted between clip 10 and spring member 18. Spring member 18 preferably extends into the path of insertion of component 4 such that when the component is inserted, spring member 18 is bent towards wall 28 of the opening. The restoring force provided by the resilience of spring member 18 biases spring member 18 against ground electrode 13, and electrode 14 of component 4 against clip 5. In this way, use of the fixed contact clip 10 ensures both mechanical stability and the separate removability of component 4 and pin 2.

The filter assembly is completed by a second insulator member 30, shown only in FIG. 3. Insulator 30 includes openings 31 shaped to receive the raised portions 26 of insulator 3, and a plurality of holes 32 for contact pins 2.

Advantageously, the components are tested after assembly, but before potting, to permit removal and replacement of any defective components. Insulators 3 and 30 provide mechanical support for the ground plate, which is electrically connected to the connector shell via a spring tine 32 located in a notch 33 as shown in FIG. 3. Of course, numerous other arrangements for grounding a ground plate to a connector shell are known to those skilled in the art, and all such arrangements are intended to be included within the scope of the invention.

As described above, therefore, the invention provides an electrical component which is electrically connected between an electrical contact pin in a connector and the connector shell. The component is not fixed to the contact pin 2, but rather is electrically connected to the contact pin by engagement with a fixed contact clip 10, and therefore is separately removable for replacement or repair. Consequently, the invention provides an exceptionally simple and mechanically stable non-permanent component mounting design with a minimum number of parts.

Having thus described a preferred embodiment of the invention, it will be appreciated that the invention should not be limited to the embodiment described above, but rather should be limited solely by the appended claims.

I claim:

1. A connector, comprising:

a conductive shell;

a first insulator member supported by said shell and including a first aperture extending through said insulator member, said first aperture arranged to permit passage of a feedthrough contact, and a second aperture extending partially through said insulator member in communication with said first aperture, said second aperture including a floor and two opposed walls which support an electrical component having first and second electrodes;

a conductive clip secured within said second aperture and including means for electrically contacting said feedthrough contact;

a ground plate including means for electrically connecting said ground plate to said shell, and a resilient ground contact member which extends into said second aperture, wherein said ground contact member is biased against said first electrode, thereby biasing said second electrode against said conductive clip in order to establish an electrical connection between said feedthrough contact and said second electrode via said conductive clip, and between said first electrode and said shell via said ground plate.

2. An electrical connector as claimed in claim 1, further comprising a passageway in communication with said first and second apertures and extending from said second aperture to an outter surface of said insulator member for receiving said means for establishing an electrical connection between said clip and said contact pin.

3. A connector as claimed in claim 2, wherein said clip is a plate spring and said means for establishing an electrical connection between said clip and said feedthrough contact comprises a spring member extending from and integral with said clip, said spring member being arranged to extend into said first aperture prior to insertion of a feedthrough contact, and to be pushed into said passageway in response to insertion of the feedthrough contact, thereby biasing said spring member against said feedthrough contact.

4. A connector as claimed in claim 1, wherein said ground plate comprises a single stamped and formed sheet of conductive material.

5. A connector as claimed in claim 1, wherein said clip comprises means including barbs which penetrate said two walls to secure said clip within said insulator member.

6. A connector as claimed in claim 1, further comprising a second insulator member arranged to sandwich said ground plate between said first and second insulator members.

7. A connector as claimed in claim 1, wherein said insulator member includes a raised portion projecting into an opening in said ground plate for insulating said ground plate from said feedthrough contact.

8. A connector as claimed in claim 1, wherein said first insulator member comprises a plurality of said first and second apertures, each second aperture including one of said conductive clips secured therein and, extending into each second aperture, one of said resilient ground contact members integral with said ground plate, wherein the feedthrough contacts and components inserted into respective ones of said first and second apertures may be separately removed for replacement or repair.

9. An arrangement for removably mounting an electrical component in an electrical connector, comprising: electrical connector, comprising:

an insulator member having a feedthrough contact opening and an electrical component opening in communication with said contact opening;

a conductive clip and an electrical component secured in said component opening;

means on said conductive clip which engages a feedthrough contact inserted into said contact opening to establish an electrical connection between said feedthrough contact and said clip;

grounding means for electrically connecting a ground electrode of said component with ground, said grounding means including biasing means which biases a live electrode of said component against said conductive clip.

10. An arrangement as claimed in claim 9, wherein said clip and said ground electrode are planar.

11. An arrangement as claimed in claim 9, wherein said means on said conductive clip comprise a spring member integral with said clip.

12. An arrangement as claimed in claim 9, wherein said grounding means is a ground plate and said biasing means is a conductive member integral with said ground plate and extending into said component opening.

13. A connector as claimed in claim 12, wherein said clip comprises means including barbs which penetrate said two walls to secure said clip within said insulator member.

14. A connector as claimed in claim 12, further comprising a second insulator member arranged to sandwich said ground plate between said first and second insulator members.

15. A connector as claimed in claim 12, wherein said insulator member includes a raised portion projecting into an opening in said ground plate for insulating said ground plate from said feedthrough contact.

* * * * *